US009427764B2

(12) United States Patent
Duquet et al.

(10) Patent No.: US 9,427,764 B2
(45) Date of Patent: Aug. 30, 2016

(54) DISPENSING AND APPLICATION HEAD

(75) Inventors: Frédéric Duquet, Crespieres (FR); Francis Moreau, Sotteville les Rouen (FR)

(73) Assignee: APTAR FRANCE SAS, Le Neubourg (FR)

( * ) Notice: Subject to any disclaimer, the term of this patent is extended or adjusted under 35 U.S.C. 154(b) by 187 days.

(21) Appl. No.: 14/234,291

(22) PCT Filed: Aug. 1, 2012

(86) PCT No.: PCT/FR2012/051817

§ 371 (c)(1),
(2), (4) Date: Jan. 22, 2014

(87) PCT Pub. No.: WO2013/017801

PCT Pub. Date: Feb. 7, 2013

(65) Prior Publication Data

US 2014/0161504 A1 Jun. 12, 2014

(30) Foreign Application Priority Data

Aug. 1, 2011 (FR) ..... 11 57034

(51) Int. Cl.
*A45D 34/04* (2006.01)
*B05C 1/04* (2006.01)
*B05B 11/00* (2006.01)
(Continued)

(52) U.S. Cl.
CPC ..... *B05C 1/04* (2013.01); *A45D 34/04* (2013.01); *A45D 34/042* (2013.01);
(Continued)

(58) Field of Classification Search
CPC ..... A45D 2200/15; A45D 2200/155; A45D 2200/157
USPC ..... 401/1, 2, 6, 148, 188 R, 265, 266
See application file for complete search history.

(56) References Cited

U.S. PATENT DOCUMENTS

2007/0206986 A1* 9/2007 Gueret ..... A45D 34/04 401/123
2008/0279616 A1 11/2008 Thorpe
(Continued)

FOREIGN PATENT DOCUMENTS

DE 20 2004 018 315 U1 3/2005
GB 2 449 141 A 11/2008
(Continued)

OTHER PUBLICATIONS

English translation of the International Preliminary Report on Patentability for PCT/FR2012/051817.

*Primary Examiner* — David Walczak
*Assistant Examiner* — Joshua Wiljanen
(74) *Attorney, Agent, or Firm* — Sughrue Mion, PLLC

(57) ABSTRACT

A dispenser and applicator head (T1) for associating with a dispenser unit (2), the head comprising:

Figure 1A:
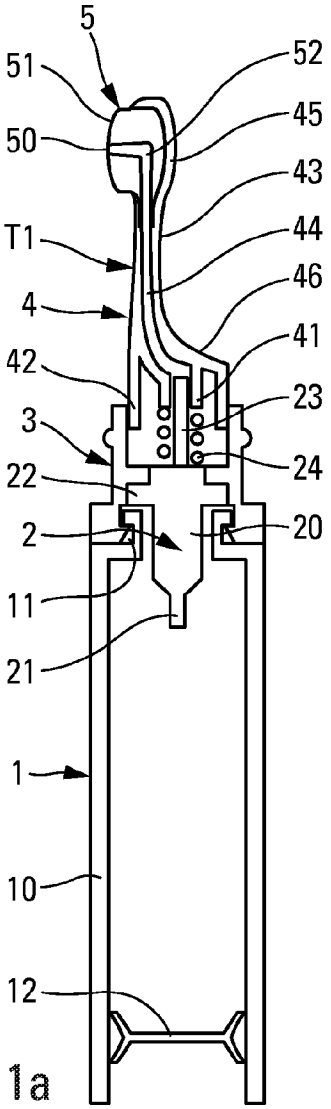

a connection section (4*a*) for connecting to the dispenser unit;

a fluid application section (4*c*) that defines at least one fluid dispenser orifice (50), and a fluid applicator pad (51) for applying the fluid coming from the dispenser orifice (50) onto the application surface;

an interconnection section (4*b*) that interconnects the connection section (4*a*) and the application section (4*c*);

the dispenser and applicator head being characterized in that:

the applicator pad (51) is made of a rigid heat-transfer material so as to impart a cold sensation on contact with the skin; and the interconnection section (4*b*) is made of an elastically-deformable material, such that the applicator pad (51) is movable relative to the connection section (4*a*).

14 Claims, 3 Drawing Sheets

(51) Int. Cl.
*B65D 83/28* (2006.01)
*B65D 83/40* (2006.01)

(52) U.S. Cl.
CPC ..... *B05B 11/0091* (2013.01); *B65D 83/285* (2013.01); *A45D 2200/056* (2013.01); *A45D 2200/1018* (2013.01); *A45D 2200/155* (2013.01); *B05B 11/3023* (2013.01); *B05B 11/3047* (2013.01); *B05B 11/3074* (2013.01); *B65D 83/40* (2013.01)

(56) References Cited

U.S. PATENT DOCUMENTS

2010/0178095 A1* 7/2010 Bouix ..... A45D 40/267 401/1
2011/0103878 A1* 5/2011 Neuner ..... A45D 34/04 401/203
2013/0223913 A1* 8/2013 Duru ..... A45D 34/04 401/2
2014/0234004 A1* 8/2014 Thorpe ..... A45D 40/26 401/1
2014/0376985 A1* 12/2014 Villarreal ..... A45D 34/041 401/2
2015/0086259 A1* 3/2015 Moreau ..... A45D 34/04 401/266

FOREIGN PATENT DOCUMENTS

WO 2006/106256 A2 10/2006
WO 2012/025691 A1 3/2012

* cited by examiner

DISPENSING AND APPLICATION HEAD

CROSS REFERENCE TO RELATED APPLICATIONS

This application is a National Stage of International Application No. PCT/FR2012/051817, filed Aug. 1, 2012, claiming priority based on French Patent Application No. 1157034, filed Aug. 1, 2011, the contents of all of which are incorporated herein by reference in their entirety.

The present invention relates to a dispenser and applicator head for associating with a dispenser unit, such as a pump, a valve, a squeezable tube, etc. The head comprises a connection section that is connected to the dispenser unit, a fluid application section for coming into contact with an application surface, such as the skin, and an interconnection section that interconnects the connection section and the application section. The present invention also defines a fluid dispenser including such a dispenser and applicator head. Advantageous fields of application of the present invention are the fields of cosmetics, perfumery, and pharmacy.

In the fields of cosmetics and pharmacy, fluid dispensers already exist comprising a fluid reservoir associated with a rigid and heat-transfer dispenser head for putting into contact with the skin, in particular the skin of the face. The head forms an applicator pad from which a dispenser orifice opens out. The user actuates the dispenser so as to dispense a dose of fluid, and then spreads it by means of the applicator pad which provides a massaging effect and above all a cold sensation on contact with the skin which is very pleasant.

A major drawback with that type of dispenser resides in the fact that the pad is rigid, such that it transmits all of the hand movements of the user, which are often uncontrolled, sudden, and aggressive. As a result, applying the fluid by means of the pad requires great concentration in order for it to be good, thereby removing a portion of the pleasure provided by the massaging and cold effect.

In addition, there also exist dispensers incorporating a ball that is mounted to turn freely in a That type of dispenser is commonly designated by the term "roll-on" because of its ball that rolls freely in the housing in communication with the fluid. Thus, by applying the ball against an application surface such as the skin, it rolls over the skin and revolves in its housing. Given that the ball is directly in contact with the fluid of the reservoir, it is loaded on one side with fluid, and is unloaded on the other side in contact with the skin. The fluid from the reservoir may thus be applied onto the skin. Furthermore, the ball provides a massaging effect that improves the sensation of the application. In addition, given that the ball is often made of metal or another heat-transfer material, it also provides a cold sensation on contact with the skin, which sensation is even more pleasant when combined with the massage effect. Such "roll-on" dispensers are thus particularly appreciated by users.

However, a major drawback exists with that type of "roll-on" dispenser associated with the fact that the ball in contact with the skin is loaded with impurities and/or with micro-organisms that are then taken inside the reservoir as a result of the ball revolving. Given that the fluid from the reservoir can reach the portion of the ball in contact with the skin, said portion of the ball in contact with the skin can also reach the reservoir and thus contaminate the fluid contained therein. Consequently, the "roll-on" type dispenser does not provide satisfactory hygiene, very particularly for certain fluids that are sensitive or fragile.

An object of the present invention is to remedy the above-mentioned drawbacks of the prior art by defining a different type of dispenser and applicator head that provides greater advantages in terms of quality of application, of massage, and of sensations on contact with the skin, and that is much easier to use. The main object of the present invention is also to avoid causing the fluid stored in the reservoir being contaminated by the surface of the head in contact with the skin.

To do this, the present invention proposes a dispenser and applicator head for associating with a dispenser unit, such as a pump, a valve, or a squeezable tube, the head comprising:

- a connection section for connecting to the dispenser unit;
- a fluid application section that defines at least one fluid dispenser orifice, and a fluid applicator pad for coming into contact with an application surface, such as the skin, for applying the fluid coming from the dispenser orifice onto the application surface;
- an interconnection section that interconnects the connection section and the application section;

the dispenser and applicator head being characterized in that:

- the applicator pad is made of a heat-transfer material, such as metal or ceramic, so as to impart a cold sensation on contact with the skin; and
- the interconnection section is made of an elastically-deformable material, such that the applicator pad is movable relative to the connection section.

The hard and cold sensation of the rigid pad and of the prior-art ball has been preserved in the present invention, but the sudden and aggressive movement has been eliminated or at least attenuated by the elastically-deformable interconnection, such that the pad moves over the skin with a damped effect. The flexible interconnection section makes it possible to transmit the user's hand movements to the pad in attenuated manner: as a result, any sudden hand movements are not transmitted to the pad in contact with the skin. Without the flexible interconnection section, all of the hand movements would be transmitted directly to the pad, and even more so when said pad is made of a hard material that transfers all hand movements directly. The present invention thus resides in the synergetic combination of its two characteristics, namely an applicator pad made of hard heat-transfer material, and a flexible interconnection section interconnecting the pad and the remainder of the dispenser.

In an advantageous embodiment, the head comprises:

- an applicator piece made of a rigid heat-transfer material, such as metal or ceramic, forming at least one portion of the application section; et
- a connection and interconnection piece made of plastics material, forming the connection section and the interconnection section, the connection and interconnection piece being overmolded on the applicator piece.

The head of the invention could comprise a greater number of pieces, but preferably it comprises only these two pieces, namely the applicator piece and the connection and interconnection piece. The two pieces are assembled together by means of a particularly advantageous technique, namely the technique of overmolding plastics material on the applicator piece made of dense material. The fluid is delivered from the connection section to the applicator piece through the interconnection section that internally forms a delivery channel.

In a particular embodiment, the application section is formed by the applicator piece and the connection and interconnection piece overmolded on the applicator piece.

According to an advantageous characteristic of the invention, the dispenser orifice is formed by the applicator pad. In a variant, the dispenser orifice is formed beside the applicator pad.

In another aspect of the present invention, the applicator pad may define a generally plane application zone in which the dispenser orifice is formed. Advantageously, the application zone extends transversally relative to the interconnection section.

According to another advantageous characteristic of the invention, the interconnection section is substantially isotropically deformable about an axis, in such a manner as to enable the pad to move with a ball-joint movement. In other words, the interconnection section is not merely movable along a line, but is movable in such a manner as to describe a spherically-shaped surface, like a ball joint. The degrees of freedom of the pad is thus increased, giving the sensation that it is uncoupled from the connection section. Deformation of the interconnection section that is isotropic is a characteristic that may be protected in itself, independently of the heat-transfer properties of the application section.

The present invention also defines a fluid dispenser comprising a fluid dispenser unit and a dispenser and applicator head as defined above, wherein the dispenser unit comprises an axially-actuated pump that is provided with an axially-movable actuator rod on which the connection section is mounted, the head advantageously forming an axial pusher. The user thus begins by actuating the pump so as to dispense a dose of fluid, then applies the pad against the application surface (e.g. the skin), and may then begin to apply the fluid by means of the pad.

The present invention defines another dispenser comprising a laterally-actuated pump that is provided with a lateral pusher and with a stationary axial outlet on which the connection section is mounted. With this dispenser, it is possible to actuate the pump while the pad is already in contact with the skin, given that the actuation of the pump does not cause the pad to move.

The present invention defines a third dispenser wherein the dispenser unit comprises a squeezable tube including an opening on which the connection section is mounted. This is the simplest method of application, in which it suffices to squeeze the squeezable tube so as to cause the fluid to be dispensed at the pad which may then be applied against the skin.

One of the principles of the present invention resides in associating a flexible interconnection section with an applicator pad made of heat-transfer material, so as to reproduce and/or approach the performance of a conventional dispenser of the "roll-on" type. The ball-joint effect of the pad provided by the isotropically-deformable interconnection section makes it even more possible to come close to the sensation provided by the rotary ball of the "roll-on" type dispenser.

The invention is described more fully below with reference to the accompanying drawings, which show several embodiments of the invention as non-limiting examples.

Figure 1B:
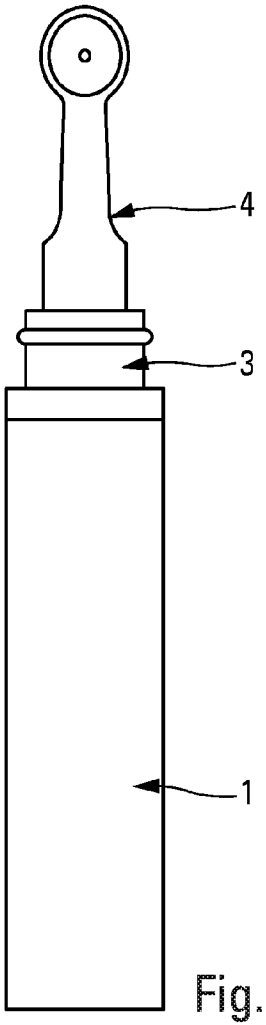
Figure 2A:
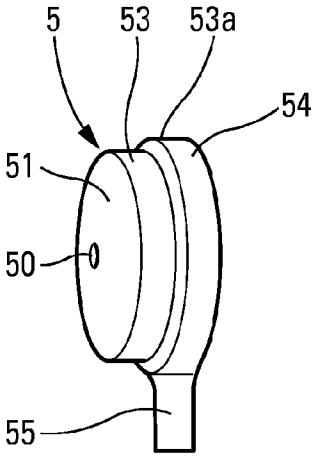

In the figures:

FIG. 1*a* is a vertical-section view through a fluid dispenser in a first embodiment of the invention;

FIG. 1*b* is an elevation view of the FIG. 1*a* dispenser;

FIG. 2*a* is a larger-scale perspective view of the applicator piece used in the dispenser in FIGS. 1*a* and 1*b;*

Figure 2B:
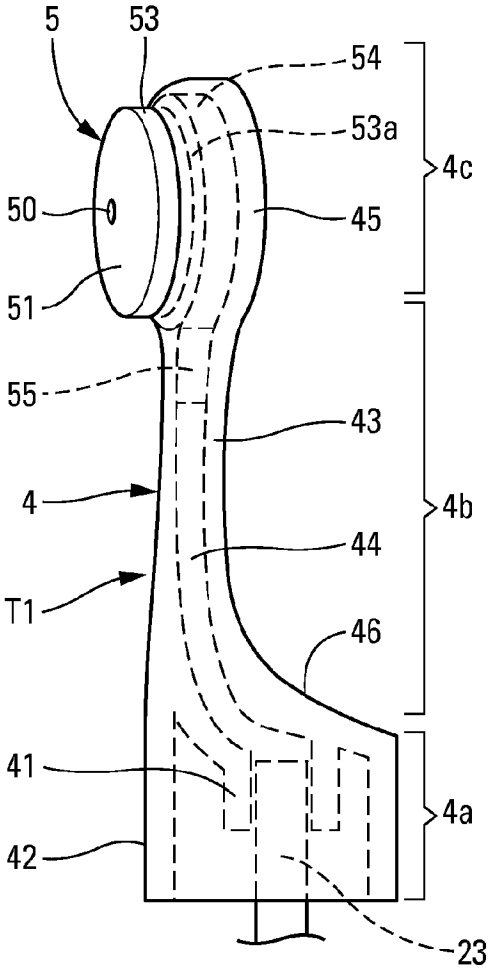

FIG. 2*b* is a larger-scale transparent perspective view of the dispenser head T1 of the dispenser in FIGS. 1*a* and 1*b;*

Figure 4:
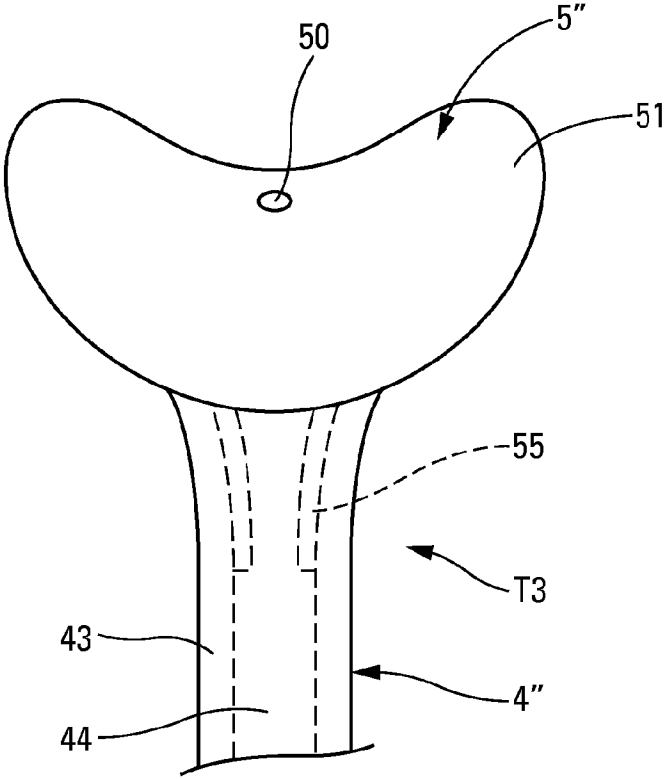
Figure 3B:
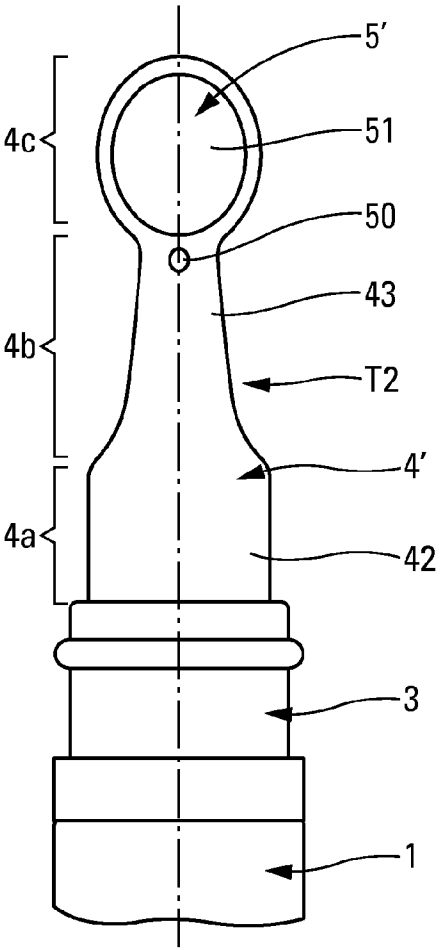
Figure 3A:
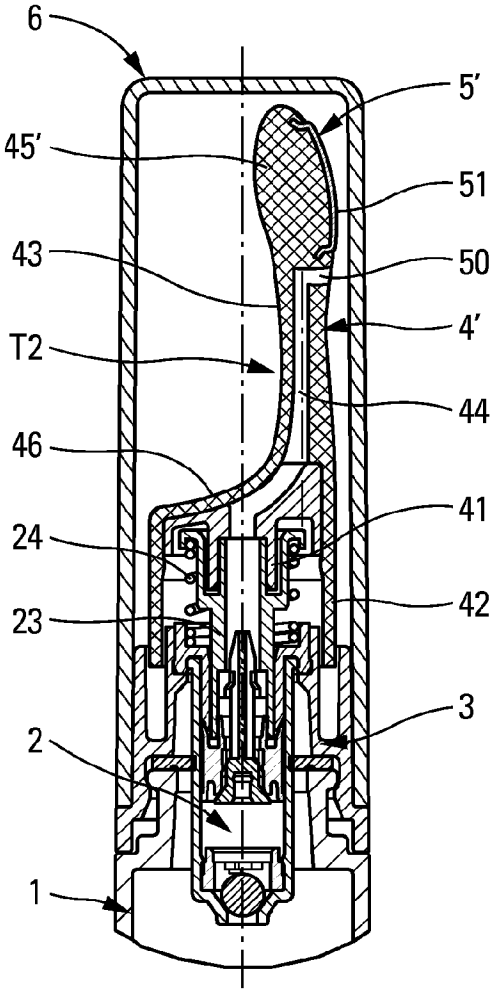
Figure 6B:
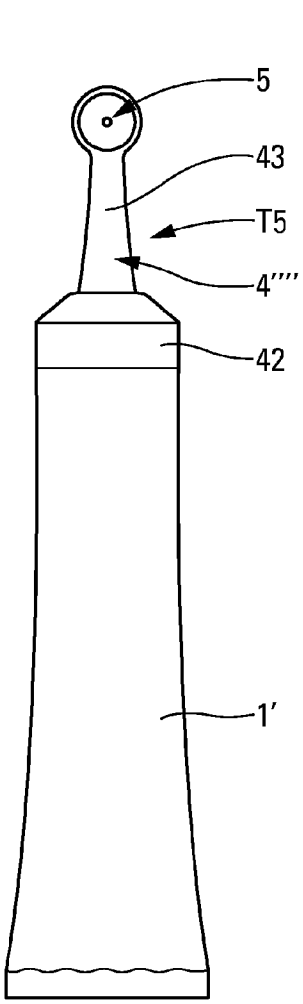
Figure 6A:
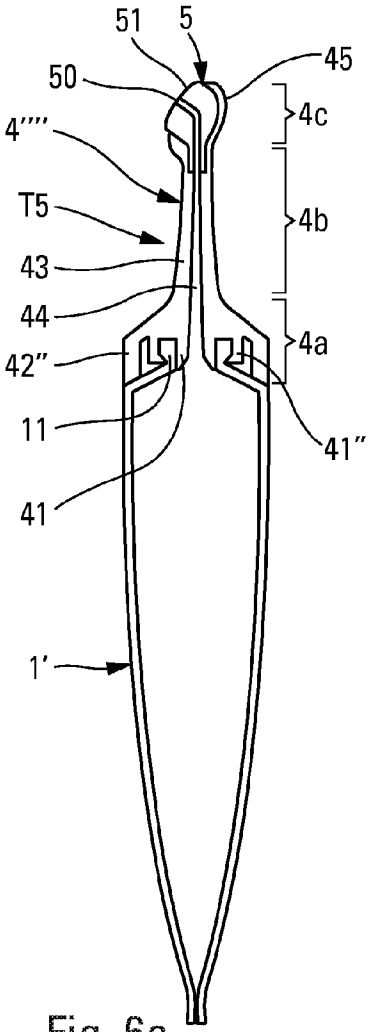
Figure 5B:
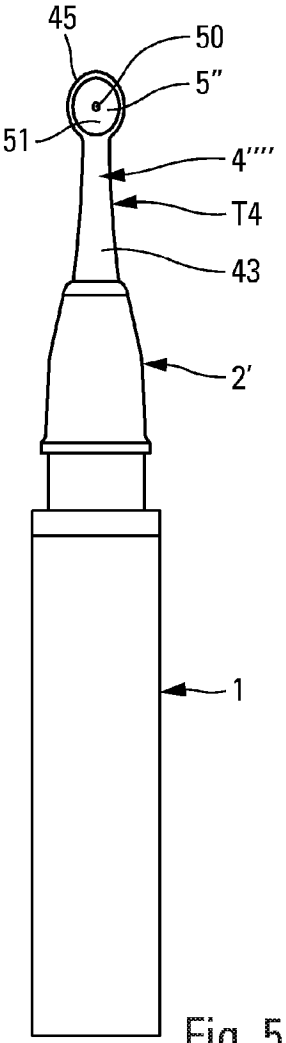
Figure 5A:
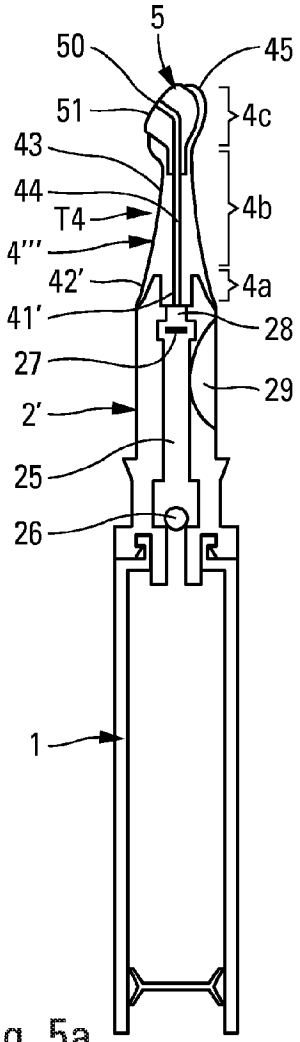

FIGS. 3*a* and 3*b* are views similar to FIGS. 1*a* and 1*b* respectively in a second embodiment of the invention;

FIG. 4 is a larger-scale transparent perspective view of an applicator piece in a third embodiment of the invention;

FIGS. 5*a* and 5*b* are views similar to FIGS. 1*a* and 1*b* respectively in a fourth embodiment of the invention; and FIGS. 6*a* and 6*b* are views similar to FIGS. 1*a* and 1*b* respectively in a fifth embodiment of the invention.

Reference is made initially to FIGS. 1*a,* 1*b,* 2*a* and 2*b* in order to describe in detail the structure of the fluid dispenser device in the first embodiment of the invention. The dispenser essentially comprises five component elements, namely a fluid reservoir 1, a dispenser unit 2 that is a conventional axially-actuated pump in this embodiment, a fastener ring 3 for fastening the pump on the reservoir, and a dispenser head T1 that is constituted by a connection and interconnection piece 4 associated with an applicator piece 5.

The fluid reservoir 1 may be of any kind, of any shape, and made of various appropriate materials. In the field of cosmetics, it is common to use a particular reservoir, as shown in FIG. 1*a,* that comprises a cylindrical slide cylinder 10 associated with a follower piston 12 that moves along the cylinder 10 as fluid is removed therefrom. This type of reservoir makes it possible to keep the fluid out of contact with the outside air. When the reservoir is full, the follower piston 12 is located at an end of the cylinder 10 that is remote from the other end of the cylinder where a neck 11 is formed that defines an opening that puts the inside of the reservoir into communication with the outside. This design is entirely conventional for a reservoir of the follower-piston type.

The pump 2 is a conventional axially-actuated pump that includes a pump body 20 that, at its bottom end, defines a fluid inlet 21 that is in communication with the reservoir 1. At its opposite end, the pump body 20 may define a holding collar 22 that serves to fasten the pump on the neck 11 of the reservoir. The pump 2 further includes an actuator rod 23 that is movable downwards and upwards along an axis that coincides with the axis of symmetry and of revolution of the pump. Driving the actuator rod 23 into the pump body 20 decreases the volume of an internal pump chamber that is full of fluid. The fluid is thus put under pressure, and the opening of an outlet valve enables the fluid to be driven through the actuator rod 23. By relaxing the actuator rod 23, the pump chamber fills once again with fluid by suction through the inlet 21. In order to return the actuator rod 23 into its rest position corresponding to the maximum volume of the pump chamber, a return spring 24 is provided that is situated outside the pump chamber and the pump body 20. Except for the arrangement of the spring outside the pump body, the pump 2 presents a configuration that is entirely conventional.

The main function of the fastener ring 3 is to hold the pump 2 firmly on the neck 11 of the reservoir 1. The fastener ring 3 may be snap-fastened, screw-fastened, or crimped on the neck 11 of the reservoir. It may press the collar 22 of the pump body 20 against the top edge of the neck 11, possibly with a neck gasket (not shown) interposed therebetween.

The dispenser and applicator head T1 is mounted on the free end of the actuator rod 23 and includes an internal delivery duct 44 that enables the fluid to be dispensed through a dispenser orifice 50. As already mentioned, the dispenser and applicator head T1 is constituted by a connection and interconnection piece 4 associated with an applicator piece 5. The connection and interconnection piece 4 is made of plastics material, whereas the applicator piece 5 is made of a rigid or hard heat-transfer material, such as metal, ceramic, an inorganic material, etc. that is suitable for imparting a cold sensation on contact with the skin. Preferably, the piece 5 presents considerable wall thickness so as to increase its thermal inertia.

With reference to FIG. 2*a*, there can be seen the detailed structure of the applicator piece 5. It includes an applicator pad 51 that defines an application zone for coming into contact with the skin. The application zone may extend transversally to the longitudinal axis constituted by the dispenser. The dispenser orifice 50 passes through the applicator pad 51 and is extended internally by an internal channel 52 as far as an interconnection endpiece 55. Around the applicator pad 51, the piece 5 forms a substantially-cylindrical skirt 53 that is extended by an outer shoulder 53*a* that is connected to an annulus 54. It should be observed that the piece 5 is relatively massive so as to improve the cold sensation on contact with the skin. With reference to FIG. 2*b*, it can be seen how the applicator piece 5 is incorporated in the connection and interconnection piece 4 so that together they form the dispenser and applicator head T1. The connection and interconnection piece 4 defines three distinct sections, namely a connection section 4*a*, an interconnection section 4*b*, and an application section 4*c* together with the applicator piece 5. More precisely, the plastics material constituting the piece 4 is overmolded on the applicator piece 5 in such a manner as to form a kind of overmolded shell 45. The overmolded shell 45 extends around the shoulder 53*a* and the annulus 54, and around a portion of the skirt 53, while nevertheless leaving the applicator pad 51 and its dispenser orifice 50 free. At the interconnection section 4*b*, the connection and interconnection piece 4 extends around the interconnection endpiece 55 that internally forms the channel 52 leading to the dispenser orifice 50. In the interconnection section 4*b*, the piece 4 forms a tube 43 that internally defines the internal delivery duct 44. According to the invention, in the interconnection tube 43, the interconnection section 4*b* is elastically deformable. Such deformability is imparted by the intrinsic qualities of the plastics materials used and/or by having small wall thicknesses at this location. At its wide bottom end, the interconnection section 4*b* forms an axial pusher 46 on which the user can press by means of one or more fingers so as to move the dispenser head T1 downwards and upwards in such a manner as to actuate the pump 2. At its bottom end, the interconnection section 4*b* is connected to the connection section 4*a* that comprises a connection sleeve 41 that is interfitted on the free end of the actuator rod 23 of the pump, and an outer skirt 42 that surrounds the sleeve 41 coaxially. The connection section 4*a* presents stiffness that is greater than the stiffness of the interconnection section 4*b*, mainly as a result of the increased wall thicknesses. It should be observed that the flexible tube 43 extends in offset or off-center manner relative to the axis constituted by the actuator rod 23. Thus, the pusher 46 may extend above the actuator rod 23, thereby enabling the pump 2 to be actuated in completely axial manner.

The dispenser and applicator head T1 associates a heat-transfer and cold sensation applicator pad 51 with an interconnection section 4*b* that is elastically deformable as a result of the deformability qualities of the interconnection tube 43. Once in place on the actuator rod 23 of the pump 2, the user may press on the pusher 46 so as to dispense a dose of fluid at the dispenser orifice 50. Then, the pad may be applied to a desired application surface, such as the skin, and the fluid may be spread by moving the pad over the skin, thereby imparting a cold massage sensation thereto. The movements of the hand imparted to the reservoir 1 are transmitted to the pad with an attenuated or damped effect, as a result of the springiness of the interconnection section 4*b*.

FIGS. 3*a* and 3*b* show a second embodiment of the invention. The reservoir 1, the pump 2, and the fastener ring 3 may be entirely identical. The dispenser and applicator head T2 of the second embodiment differs in the design of the application section formed by the applicator piece 5' and the connection and interconnection piece 4'. The free end portion of the piece 4' may be shaped like the stone 45' of a fruit having the applicator piece 5' applied thereon, which piece is in the form of a plate in this embodiment. The stone 45' may be overmolded on the applicator piece 5', or, in a variant, the applicator piece 5' may be snap-fastened, force-fitted, adhesively-bonded, etc. on the stone 45'. Another difference resides in the positioning of the dispenser orifice 50 that is situated beside the piece 5'. The orifice 50 is situated in the application section 4*c* or at the end of the section 4*b*, just below the pad 51. Optionally, the dispenser and applicator head T2 may be covered by a protective cap 6 that comes into engagement with the fastener ring 3. With the head T2, the fluid that leaves via the orifice 50 is then spread by the pad 51 that is positioned just above.

As in the first embodiment, the connection and interconnection piece 4' includes a flexible interconnection tube 43 that makes it possible to uncouple the applicator pad 51 mechanically from the bottom portion of the head T2 forming the connection sleeve 41 that is connected to the actuator rod 23 of the pump 1. The applicator pad 51 may thus be moved over the skin of a user with a damped effect relative to the movement of the hand of the user in engagement with the reservoir.

FIG. 4 is a larger-scale view of a third embodiment of a dispenser and applicator head T3 of the invention. This head also includes a flexible interconnection tube 43 that makes it possible to uncouple the applicator piece 5" from the remainder of the dispenser. The applicator piece 5" also includes an interconnection endpiece 55 in engagement with the interconnection tube 43. What differs from the above embodiments is the shape of the pad 51 that presents an application zone that is extensive and slightly concave. The application zone is generally plane and extends transversally to the longitudinal axis of the interconnection section or of the dispenser. All of the shapes of the pad 51 are rounded in such a manner as to impart a more gentle sensation on contact with the skin. The connection and interconnection piece 4" may extend around the pad 51, or merely around the interconnection endpiece 55 such that the application section is merely constituted by the applicator piece 5". This imparts to the head T3 a particular configuration in which the pad 51 literally appears to be detached from the flexible interconnection tube 43.

FIGS. 5*a* and 5*b* show a fourth embodiment of the invention in which a dispenser and applicator head T4 is associated with a laterally-actuated pump 2' that is mounted on a reservoir 1 that is identical or similar to the reservoir of the first embodiment. The pump 2' includes an inlet valve 26 and an outlet valve 27 between which there is formed a pump chamber 25 including a laterally-actuated wall 29 that makes it possible to reduce the internal volume of the chamber 25. It should be observed that the outlet 28 of the pump 2' is stationary and situated on the axis of the pump and of the dispenser. The head T4 is mounted on the outlet 28 of the pump 2' such that it is not subjected to any movement while the pump 2' is being actuated by the lateral pusher 29. The head T4 also includes a connection section 4*a* comprising a connection sleeve 41' and an outer skirt 42'.

The interconnection section 4*b* also includes a flexible interconnection tube 43 that internally defines an internal delivery duct 44. The application section 4*c* may be entirely identical to the application section shown in FIG. 2*b* or in FIG. 3*a* and it includes an applicator pad 51 surrounding a dispenser orifice 50.

FIGS. 6*a* and 6*b* show a fifth embodiment of the invention in which a dispenser and applicator head T5 of the invention is associated with a reservoir 1' that is in the form of a squeezable tube provided with a rigid neck 11. The head T5 is still constituted by an applicator piece 5 that is associated with a connection and interconnection piece 4"". The connection section 4*a* comprises an attachment ring 41" in engagement with the neck 11, and an outer skirt 42". The interconnection section 4*b* comprises a flexible tube 43 internally defining an internal delivery duct 44 that is connected to the applicator piece 5, which may be identical to the applicator piece of the first embodiment. In other words, the applicator section 4*c* is formed by a shell 45 made of plastics material that is overmolded on the applicator piece 5.

The various above-described embodiments show that a dispenser and applicator head of the invention may be associated with various types of dispenser unit, whether it be a conventional axially-actuated pump, a laterally-actuated pump, or even a mere squeezable tube. The behaviour of the head remains the same, namely mechanically uncoupling the applicator pad 51 relative to the remainder of the dispenser as a result of the interconnection section 4*b* being elastically deformable. By means of this dispenser and applicator head, the same application and sensation qualities are provided as in a prior-art dispenser, but without its drawbacks.

The invention claimed is:

1. A dispenser and applicator head for associating with a dispenser unit, the head comprising:

a connection section for connecting to the dispenser unit;

a fluid application section that defines at least one fluid dispenser orifice, and a fluid applicator pad for coming into contact with a person's skin, for applying the fluid coming from the dispenser orifice onto the skin;

an interconnection section that interconnects the connection section and the application section;

the dispenser and applicator head being characterized in that:

the applicator pad is made of a heat-transfer material, so as to impart a cold sensation on contact with the skin; and the interconnection section is made of an elastically-deformable material, such that the applicator pad is movable relative to the connection section when the pad is brought into contact with the skin or pressed against the skin in order to apply the fluid to the skin.

2. A head according to claim 1, comprising:

an applicator piece made of a rigid heat-transfer material, forming at least one portion of the application section; and a connection and interconnection piece made of plastics material, forming the connection section and the interconnection section, the connection and interconnection piece being overmolded on the applicator piece.

3. A head according to claim 1, wherein the application section is formed by an applicator piece and the connection and interconnection piece overmolded on the applicator piece.

4. A head according to claim 1, wherein the dispenser orifice is formed by the applicator pad.

5. A head according to claim 1, wherein the dispenser orifice is formed beside the applicator pad.

6. A head according to claim 1, wherein the applicator pad defines a generally plane application zone in which the dispenser orifice is formed.

7. A head according to claim 6, wherein the application zone extends transversally relative to the longitudinal axis of the interconnection section.

8. A head according to claim 1, wherein the interconnection section is substantially isotropically deformable about an axis, in such a manner as to enable the pad to move with a ball-joint movement.

9. A fluid dispenser comprising a fluid dispenser unit and a dispenser and applicator head according to claim 1 wherein the dispenser unit comprises an axially-actuated pump that is provided with an axially-movable actuator rod on which the connection section is mounted, the head advantageously forming an axial pusher.

10. A fluid dispenser comprising a fluid dispenser unit and a dispenser and applicator head according to claim 1, wherein the dispenser unit comprises a laterally-actuated pump that is provided with a lateral pusher and with a stationary axial outlet on which the connection section is mounted.

11. A fluid dispenser comprising a fluid dispenser unit and a dispenser and applicator head according to claim 1, wherein the dispenser unit comprises a squeezable tube including an opening on which the connection section is mounted.

12. A head according to claim 1, wherein the dispenser unit is a pump, a valve, or a squeezable tube.

13. The head according to claim 1, wherein the heat-transfer material is metal or ceramic.

14. The head according to claim 1, wherein the applicator piece made of a rigid heat-transfer material that is metal or ceramic.

* * * * *